United States Patent [19]

Thomson

[11] Patent Number: 4,917,035

[45] Date of Patent: Apr. 17, 1990

[54] MONOHULL SAILBOAT WITH ENLARGED DECK AREA

[76] Inventor: John E. Thomson, 405 Hazel Dr., Vestal, N.Y. 13850

[21] Appl. No.: 217,708

[22] Filed: Jul. 11, 1988

[51] Int. Cl.[4] ..... B63B 35/00

[52] U.S. Cl. ..... 114/39.1; 114/138; 114/355

[58] Field of Search ..... 114/39.1, 355, 357, 114/138

[56] References Cited

U.S. PATENT DOCUMENTS

| | | | |
|---|---|---|---|
| 3,850,127 | 11/1974 | Thorpe | 114/138 |
| 3,956,785 | 5/1976 | Halfon | 114/357 |
| 4,161,796 | 7/1979 | Kostanecki | 114/357 |

OTHER PUBLICATIONS

Mystic River Catboat, in the 1976 Sailboat and Equipment Directory, published by Sail Magazine, p. 169.

Sandpiper, in the 1976 Sailboat and Equipment Directory, published by Sail Magazine, p. 171.

*Primary Examiner*—Sherman D. Basinger
*Assistant Examiner*—Thomas J. Brahan
*Attorney, Agent, or Firm*—Kenneth P. Johnson

[57] ABSTRACT

A lightweight monohull sailboat of length less than sixteen feet having a clear uninterrupted, full beam, deck area above the waterline of the hull of at least sixteen square feet. The sailboat is molded fiberglass or plywood construction including integral flotation chambers and having removable mast, sail and tiller that permit the sailboat to be easily loaded on a cartop by one person. The sailboat readily accomodates at least two adults for sleeping when launched.

2 Claims, 1 Drawing Sheet

MONOHULL SAILBOAT WITH ENLARGED DECK AREA

FIELD OF THE INVENTION

This invention relates generally to sailboats and, more particularly to monohulled, portable sailboats with a large uninterrupted deck area.

BACKGROUND OF THE INVENTION

Nearly all small monohull sailboats designed for portability, usually via cartop carriers and loaded by one or two individuals, are limited to day sailers. These sailboats are frequently of molded fiberglass, double hull construction with removable centerboard, mast, sail and tiller. The cockpit is extremely limited in size, being able to safely seat two or three adults and offering as inboard deck area only the preformed seats along each gunwale. Further, passengers' feet or gear often get wet due to the depressed deck. Because of the small cockpit and its irregular elevation, these boats hold no attraction, and are even impossible to use, as overnight sleeping accomodations because they lack sufficient comfortable, sleeping area for at least two adult people. When attempts have been made to enlarge the deck area for sleeping, the weight has been increased by extending the boat length and beam, thereby making the boat impossible for one person to load on a cartop. Usually such boats require the use of a trailer.

A further disadvantage of the known day sailers is instability due to their vee or arcuate hulls The hull is designed for minimum resistance and maximum speed in the water but this increases the risk of upset during operation or mooring in rough water.

Although the usual day sailer is not intended to accomodate overnight sleepers, this capability becomes highly desirable or necessary at times. And some of these boats can not readily accept suspension of a temporary canopy nor provide the desired stability.

OBJECTS AND SUMMARY OF THE INVENTION

It is accordingly a primary object of this invention to provide a highly portable monohull sailboat with improved stability and having increased clear deck area to comfortably accomodate two or three passengers overnight for sleeping.

Another important object of this invention is to provide a single mast, monohull sailboat having a flat bottom, integral bulkheads, removable centerboard with clear deck area for accomodating two or more overnight adult passengers that is cartop loadable by a single individual.

Still another object of this invention is to provide a monohull, single masted, sailboat having a recessed, but removable, daggerboard and removable hatches for forming an unusually large, uninterrupted clear deck area between gunwales.

The foregoing objects are attained in accordance with this invention by providing a monohulled sailboat of less than sixteen feet in length and clear deck area of at least sixteen square feet. The sailboat has a highly stable, flat bottomed hull with sealed, airtight flotation chambers along each gunwale. These chambers extend between a mast partner in a bow, for supporting the single mast, to the headboard near the stern behind which there is stowage to accomodate gear. Removable hatch covers extend between the parallel flotation chambers fore and aft of the daggerboard support to provide the clear deck area. The daggerboard support and removable daggerboard are formed such that the daggerboard top is recessed in its support or does not protrude significantly into the surrounding deck area. A mast, rudder and tiller are each removable, as is the sail, of course, to facilitate portability.

The sailboat lends itself to fabrication of reinforced molded resins, such as fiberglass, or of plywood. As a result, it is sufficiently light in weight to enable a single adult individual to load it atop an automobile. In use, the large deck area provided through installed hatches and seats on the flotation chambers permit at least two adult occupants to sleep comfortably overnight; shelter can be easily constructed by suspending a tent over the boom and attaching it along the gunwales.

Additional objects, features and advantages of the invention will become apparent from the following, more particular description of a preferred embodiment of the invention with reference to the accompanying drawing.

DESCRIPTION OF THE PREFERRED EMBODIMENT

Figure 1:
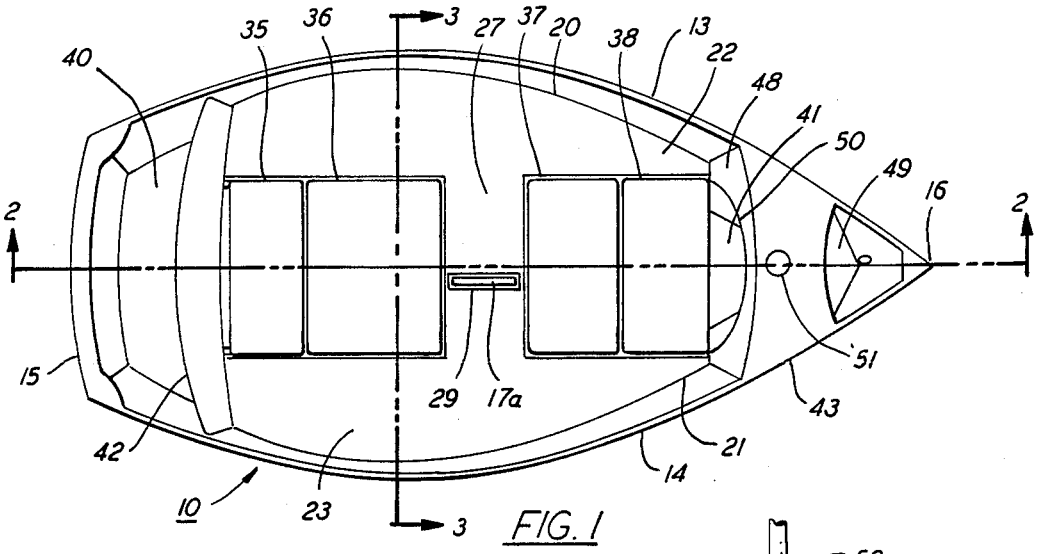
FIG. 1 is a plan view of a sailboat constructed in accordance with the principles of the invention.

Referring to the figures, sailboat 10 of this invention is a monohull type of a length less than sixteen feet, preferably twelve feet, and having a flat bottom 11 with keel 12 bisecting the bottom, and gunwales 13 and 14 joined to bottom 11 and curved or straight stern 15 and to each other to form bow 16. The gunwales flare outwardly from the bottom at an approximate 40° angle from vertical. The bottom is formed with an opening 17 along one side of the keel through which a daggerboard 18 can be removably positioned to extend below the hull. The boat beam is at least forty percent of the boat length, with the preferred beam being approximately one half the boat length at the water line. The beam is usually at least five feet. Gunwales 13 and 14 and stern 15 are between approximately twelve and sixteen inches in height with fourteen inches preferred.

Flotation chambers 20, 21 separated by about two feet are formed along each gunwale by upper, horizontal deck surfaces 22, 23 and vertical bulkheads 24, 25, respectively, joining respective gunwales 13, 14 and the interior surface of the bottom 11. The upper horizontal surfaces serve as portions of the deck along either side of the hull and bulkheads 24 and 25 are interconnected by a transverse integral horizontal surface of deck 27 at the same level as surfaces 22, 23 of the flotation chambers. Vertical sides 28 of the hollow daggerboard column join horizontal deck 27 and join the bottom. This columnar bulkhead has sealed walls (not shown) surrounding daggerboard opening 17 in bottom 11 and serves to extend the opening upwardly to the horizontal surface of deck 27 at the level of the deck, shown as opening 17*a*. Edges 29 of opening 17*a* are formed with a recess or chamfer that accepts a conforming cap 31 on daggerboard 18, allowing the daggerboard to be fully seated such that the top end or surface of the daggerboard is wedged in place and flush with horizontal surface of deck 27. Finger cutouts can be provided in cap 31 to permit convenient gripping to remove the daggerboard. The daggerboard housing is given lateral support by the permanent decking 27 between the housing and two flotation chambers.

Removable panels 35, 36, 37, 38 serve as hatches and extend between the two flotation chambers 20, 21 to form a continuous, uninterrupted deck area. Opposite facing edges of the flotation chambers and the edges of the daggerboard decking are each recessed at the juncture of the horizontal and vertical surfaces to permit the hatches to be supported and mounted so that their top surfaces are flush with the horizontal surfaces 22 and 23 when seated.

Surfaces 22 and 23 can be formed at any desired level above the waterline of the boat. Usually the tops of the flotation chambers are approximately two to four inches above the waterline when the boat is occupied.

Stowage volume for gear is provided forward and aft of the flotation chambers 20, 21 and hatches 35–38 at 40 and 41 on the hull. The length of the flotation chambers is optional; however, when the overall length of the boat is approximately twelve feet, the beam is approximately five feet and clear deck area is about thirty square feet. Therefore, the deck length is approximately seven feet. This permits the aft cargo space behind a support or headrest 42 at the rear of the deck to be about two feet in length and the forward cargo space beyond mast partner 43 to be about three feet in length.

Head support 42 has secured thereto a pair of depending legs 44 that are inserted in tubes or slots (not shown) on the facing vertical bulkhead surfaces 24, 25 forming flotation chambers 20, 21 and are arranged to position the head support at an angle sloping toward the rear at approximately 30° from the vertical. The head support preferably extends the width of the deck and upward from the deck to an arcuate top edge three to four inches above the gunwales.

Mast partner 43 is braced by a forward sloping bulkhead 48 secured near its ends to surfaces of the flo-chambers 20 and 21 and each gunwale and a rearward sloping bulkhead 49 secured between the gunwales. Both bulkheads 48 and 49 are arched at their top edges and are joined at their tops to mast partner 43. Bulkhead 48 has a cutout 50 to permit access to covered stowage beneath partner 43. An opening 51 in the decking allows a mast 52 to be inserted into mast socket 53 at the juncture of gunwales 13, 14 and keel 12, permitting the opening to serve as a lateral support. The mast socket is to the rear approximately one-sixth or less of the overall boat length from the prow. An anchor hold 54 is provided between bulkhead 49 and the prow and drain hole 55 from the compartment through one gunwale permits water to drain out.

Figure 2:
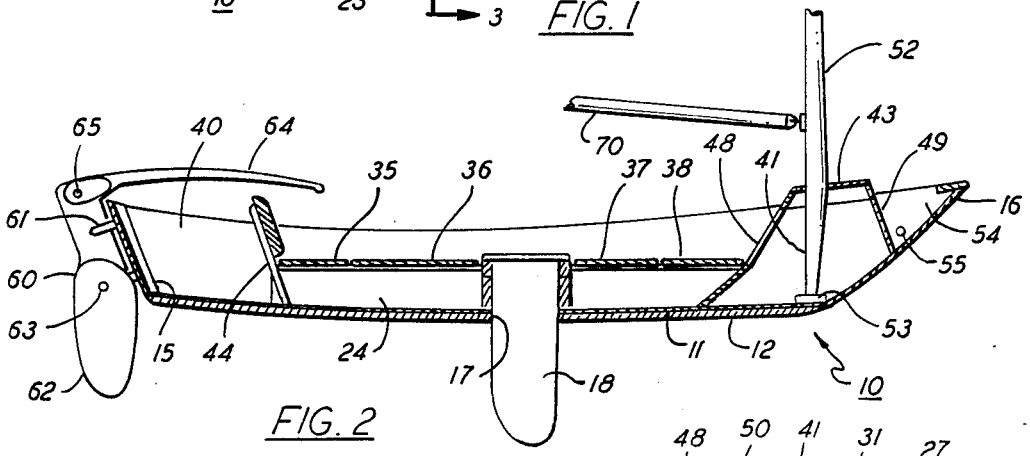
FIG. 2 is an elevation view in section of the sailboat of FIG. 1 taken along the line 2—2.
Figure 3:
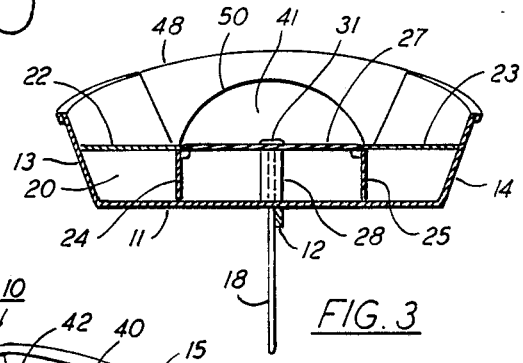
FIG. 3 is an elevation view in section of the sailboat of FIG. 1 taken along the line 3—3.
Figure 4:
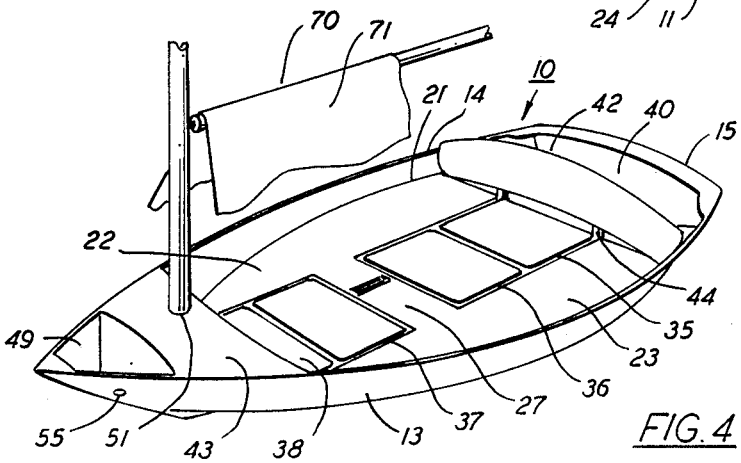
FIG. 4 is an isometric view of the sailboat shown in FIGS. 1–3.

A removable rudder 60, FIG. 2, is attached to stern 15 by gudgeons and pintles 61 and includes rudder blade 62 pivotly secured to the rudder at 63 to enable folding. Tiller 64 is similarly attached to the rudder and can be loosened at pivot 65 and folded to a more compact form.

With boom 70 attached to mast 52, a tarpaulin or tent 71 can be supported and the tarpaulin sides secured along the gunwales. This provides shelter and sleeping area for at least two adults.

It will be noted from the foregoing description that a sailing craft has been disclosed that provides proportionately a large uninterrupted deck area for its length by using the entire interior beam for deck width. A small day sailer can thus be a roomy, stable boat for overnight accomodations, if necessary.

While the invention has been particularly shown and described with reference to a preferred embodiment thereof, it will be understood by those skilled in the art that changes in form and details may be made therein without departing from the spirit and scope of the invention.

What is claimed is:

1. A portable, monohulled sailing craft comprising:

a hull of less than sixteen feet in length overall having a flat bottom and outwardly flared gunwales joined to each other at a bow and to said bottom and a stern;

a flotation chamber along each gunwale and each having a horizontal flat surface extending inwardly from the gunwale and a plurality of removable hatches extending between said chamber top surfaces so that said surfaces and hatches together form a deck above said bottom with said deck having a length of at least six feet and a substantially uninterrupted area of at least sixteen square feet;

a hollow daggerboard housing with removable daggerboard therein, said housing extending between the interior surface of said bottom and surface of said deck at the approximate center of the beam; and a headboard at the rear of said deck extending transversely of said craft between said gunwales.

2. A portable, monohulled sailboat comprising:

a hull less than fifteen feet overall in length having a flat bottom and gunwales extending between a stern and bow, with said gunwales flaring outwardly from the vertical at least twenty five degrees at the beam, said beam being at least forty percent of said overall length;

a flotation chamber along the inboard surface of each said gunwale integrally formed therewith in conjunction with said bottom and extending from a point less than twenty percent of said overall length from said stern at the gunwale to a point less than thirty percent of said overall length from said bow along said gunwale, said flotation chambers each having a horizontal planar top surface at the same elevation with said elevation being approximately two thirds of the inboard height of the hull sides above said bottom and above the waterline;

a columnar housing for receiving therein a removable daggerboard and having an opening through said bottom extending upward to a point between said flotation chambers and equal to the elevation of said top surfaces of said chambers; and a plurality of hatches extending between said top surfaces of said chambers and top of said columnar housing to provide clear, uninterrupted, flat deck area having a length at least fifty percent of said overall length and a width equal to the inboard distance between said gunwales and extending along the length of said chambers.

* * * * *